US006098543A

United States Patent [19]

Becker et al.

[11] Patent Number: 6,098,543

[45] Date of Patent: Aug. 8, 2000

[54] SUCTION GRIPPER IN A REVERSING DEVICE OF A SHEET-FED ROTARY PRINTING PRESS

[75] Inventors: Willi Becker, Bammental; Andreas Fricke, Eberbach, both of Germany

[73] Assignee: Heidelberger Druckmaschinen Aktiengesellschaft, Heidelberg, Germany

[21] Appl. No.: 09/313,893

[22] Filed: May 18, 1999

[30] Foreign Application Priority Data

May 18, 1998 [DE] Germany ..... 198 22 306

[51] Int. Cl.[7] ..... B41F 21/10

[52] U.S. Cl. ..... 101/410; 101/230; 101/409; 271/275; 271/277; 271/276

[58] Field of Search ..... 101/222, 223, 101/230, 257, 410, 411, 409; 271/275, 276, 277

[56] References Cited

U.S. PATENT DOCUMENTS 4,378,734 4/1983 Wirz ..... 101/230
4,833,989 5/1989 Wieland ..... 101/246
5,454,312 10/1995 Helmstaedter ..... 101/230
5,947,469 9/1999 Henn et al. ..... 101/410

FOREIGN PATENT DOCUMENTS 38 29 626 A1 3/1990 Germany .

*Primary Examiner*—John S. Hilten
*Assistant Examiner*—Daniel J. Colilla
*Attorney, Agent, or Firm*—Herbert L. Lerner; Laurence A. Greenberg; Werner H. Stemer

[57] ABSTRACT

In a reversing device of a sheet-fed rotary printing machine, there is provided a suction gripper for taking over a trailing edge of a sheet conveyed on an upline sheet-conveying cylinder, the suction gripper being movable out of a periphery of a downline sheet-conveying cylinder, gripping the sheet to be reversed in a region of the trailing edge thereof, and being movable back in a substantially radial direction towards the downline sheet-conveying cylinder for transferring thereat the trailing edge of the sheet to a further gripper device, including a device for converting the substantially radial return movement of the suction gripper into an axial movement of the suction gripper so as to tauten the sheet.

17 Claims, 10 Drawing Sheets

SUCTION GRIPPER IN A REVERSING DEVICE OF A SHEET-FED ROTARY PRINTING PRESS

BACKGROUND OF THE INVENTION

FIELD OF THE INVENTION

The invention relates to a suction gripper in a reversing device of a sheet-fed rotary printing machine, the suction gripper, in order to take over a trailing edge of a sheet conveyed on an upline sheet-conveying cylinder, being movable out of a periphery of a downline sheet-conveying cylinder, gripping the sheet to be reversed in a region of the trailing edge thereof, and moving back in a substantially radial direction towards the downline sheet-conveying cylinder, at which the trailing edge of the sheet is transferable to a further gripper device.

The German Published Non-prosecuted Patent Application (DT-OS) 38 29 626 discloses a sheet-fed rotary printing machine having a reversing device in which, during perfecter printing, a suction gripper is pivoted out of the periphery of a cylinder disposed downline from an impression cylinder, and towards the circumferential surface of the impression cylinder, at which it grips the trailing edge of a sheet to be reversed and, before the suction gripper passes the gripper center line between the two cylinders, it transfers this trailing edge into the periphery of the downline cylinder. In the described device, no axial smoothing of the sheets takes place after the transfer by the suction gripper and, because of the rigid and stiff configuration of the suction gripper and of the permanently predefined pivoting travel, widely varying contact forces, possibly leading to register errors, result during the processing of printing materials of different thicknesses.

The published European Patent Document EP 0 649 742 A1 discloses a further generic reversing device, in which the suction grippers which take over the trailing edge are formed as rotary suckers which, because of the configuration and weight thereof, cannot be moved out of the periphery of the downline cylinder, however, or can be moved out only with a great amount of engineering effort. As a result, particularly at the continuous printing speeds which are presently common during perfecter printing, transfer problems may occur, and these have a detrimental effect upon in-register transfer.

Furthermore, the German Patent 30 36 790 discloses a reversing device that operates on the three-drum reversing principle and has a storage drum in which suction grippers, which are arranged within the periphery of the storage drum and which hold on the storage drum the trailing edge of the sheet to be reversed, are displaceable in the axial direction along a guide rod in order to smooth the sheet trailing edge axially before it is transferred to the downline reversing drum. Because of the different reversing principle, in the case of the described device there is no axial tautening of the sheets during the transfer of the sheet trailing edge, and the suction grippers, because of the comparatively complicated mechanical configuration thereof and the fact that they are guided within the periphery of the storage drum, are comparatively heavy and cannot be moved out of the latter.

SUMMARY OF THE INVENTION

It is accordingly an object of the invention to provide a suction gripper in a reversing device of a sheet-fed rotary printing machine, the suction gripper, in order to take over a trailing edge of a sheet conveyed on an upline sheet-conveying cylinder, such as a double-sized impression cylinder, being movable out of a periphery of a downline sheet-conveying cylinder, gripping the sheet to be reversed in a region of the trailing edge thereof, and moving back in a substantially radial direction towards the downline sheet-conveying cylinder, the suction gripper, when moving back, permitting reliable and effective axial smoothing of the sheet using simple and cost-effective devices.

With the foregoing and other objects in view, there is provided, in accordance with the invention, in a reversing device of a sheet-fed rotary printing machine, a suction gripper for taking over a trailing edge of a sheet conveyed on an upline sheet-conveying cylinder, being movable out of a periphery of a downline sheet-conveying cylinder, gripping the sheet to be reversed in a region of the trailing edge thereof, and being movable back in a substantially radial direction towards the downline sheet-conveying cylinder for transferring thereat the trailing edge of the sheet to a further gripper device, comprising a device for converting the substantially radial return movement of the suction gripper into an axial movement of the suction gripper so as to tauten the sheet.

In accordance with another feature of the invention, the converting device comprises one surface member of a plurality thereof consisting of a roller rotatably fastened to the suction gripper and a sliding surface, the one surface member cooperatively engaging an inclined supporting surface disposed on the downline sheet-conveying cylinder.

In accordance with a further feature of the invention, the supporting surface is formed on a gripper pad of the further gripper device.

In accordance with an added feature of the invention, the suction gripper has a holding arm that is resilient in the axial direction and carries a suction head for gripping by suction the sheet to be reversed.

In accordance with an additional feature of the invention, the roller and the sliding surface, alternatively, are arranged directly on the resilient holding arm of the suction gripper.

In accordance with yet another feature of the invention, the roller and the sliding surface, alternatively, are arranged on the suction head of the suction gripper.

In accordance with yet a further feature of the invention, the suction gripper has a rigid holding arm whereon there is movably fastened a suction head for gripping by suction the sheet to be reversed, and a resilient member for applying to the holding arm a resilient force in the axial direction.

In accordance with yet an added feature of the invention, the roller and the sliding surface, alternatively, are arranged directly on the suction head of the suction gripper.

In accordance with yet an additional feature of the invention, the reversing device includes at least one further resilient member for applying a resilient force to the suction head in the direction of the circumferential surface of the upline sheet-conveying cylinder.

In accordance with still another feature of the invention, the suction gripper has a rigid holding arm pivotable by a gripper shaft in the substantially radial direction, the holding arm having arranged thereon a suction head pivotable in the substantially axial direction, and a resilient member braced against the holding arm for applying a force in the axial direction to the suction head.

In accordance with still a further feature of the invention, the axial tautening movement extends over a distance increasing substantially linearly with the return movement of the suction gripper towards the periphery of the downline sheet-conveying cylinder.

In accordance with still an added feature of the invention, the distance over which the axial tensioning movement extends increases substantially nonlinearly with the return movement of the suction gripper towards the periphery of the downline sheet-conveying cylinder.

In accordance with still an additional feature of the invention, the reversing device includes a multiplicity of the suction grippers for tautening the sheet, that is to be reversed, in the axial direction from the center towards the side edges thereof.

In accordance with a concomitant feature of the invention, the distance over which the axial tensioning movement of the suction grippers extends increases from the center of the sheet towards the side edges of the sheet.

Other features which are considered as characteristic for the invention are set forth in the appended claims.

Although the invention is illustrated and described herein as embodied in a suction gripper in a reversing device of a sheet-fed rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 5 is a cross-sectional view of the suction head of another embodiment of a suction gripper according to the invention;

DESCRIPTION OF THE PREFERRED EMBODIMENTS

Figure 1:
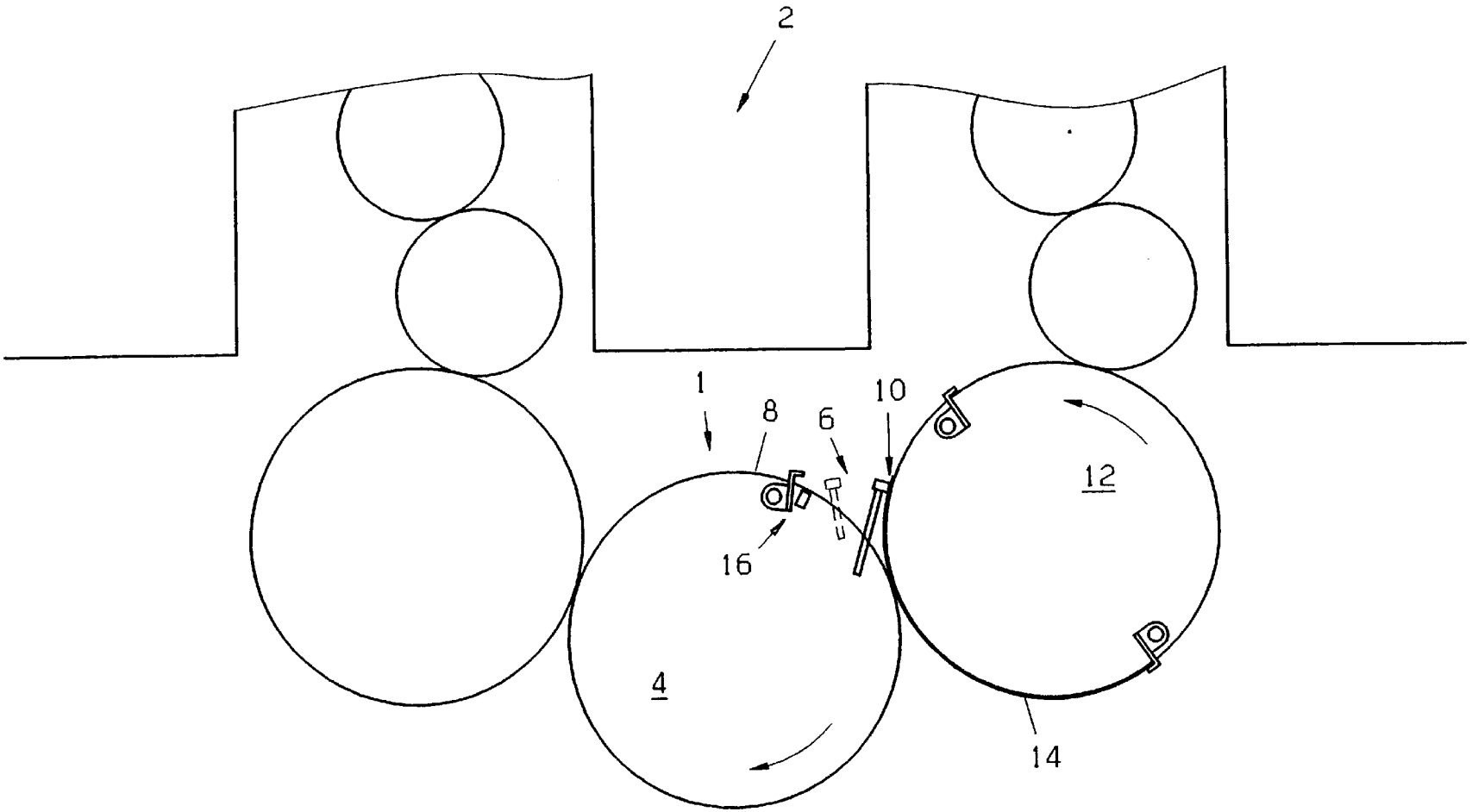
FIG. 1 is a fragmentary diagrammatic side elevational view of a sheet-fed rotary printing machine having a reversing device provided with a suction gripper according to the invention.

Referring now to the drawings and, first, particularly to FIG. 1 thereof, there is shown therein a reversing or turning device 1 of a sheet-fed rotary printing machine 2 including a downline sheet-conveying cylinder 4 or reversing drum, on which there is arranged a suction gripper 6 according to the invention which, in order to take over a trailing edge 10 of a sheet 14 conveyed on an upline sheet-conveying cylinder 12, is pivoted in a conventional manner out of the periphery 8 of the downline sheet-conveying cylinder 4, grips the trailing edge 10 of the sheet 14 and feeds it to the cylinder 4, at which the trailing edge 10 of the sheet is transferred to a gripper device 16 of the cylinder 4.

Figure 2A:
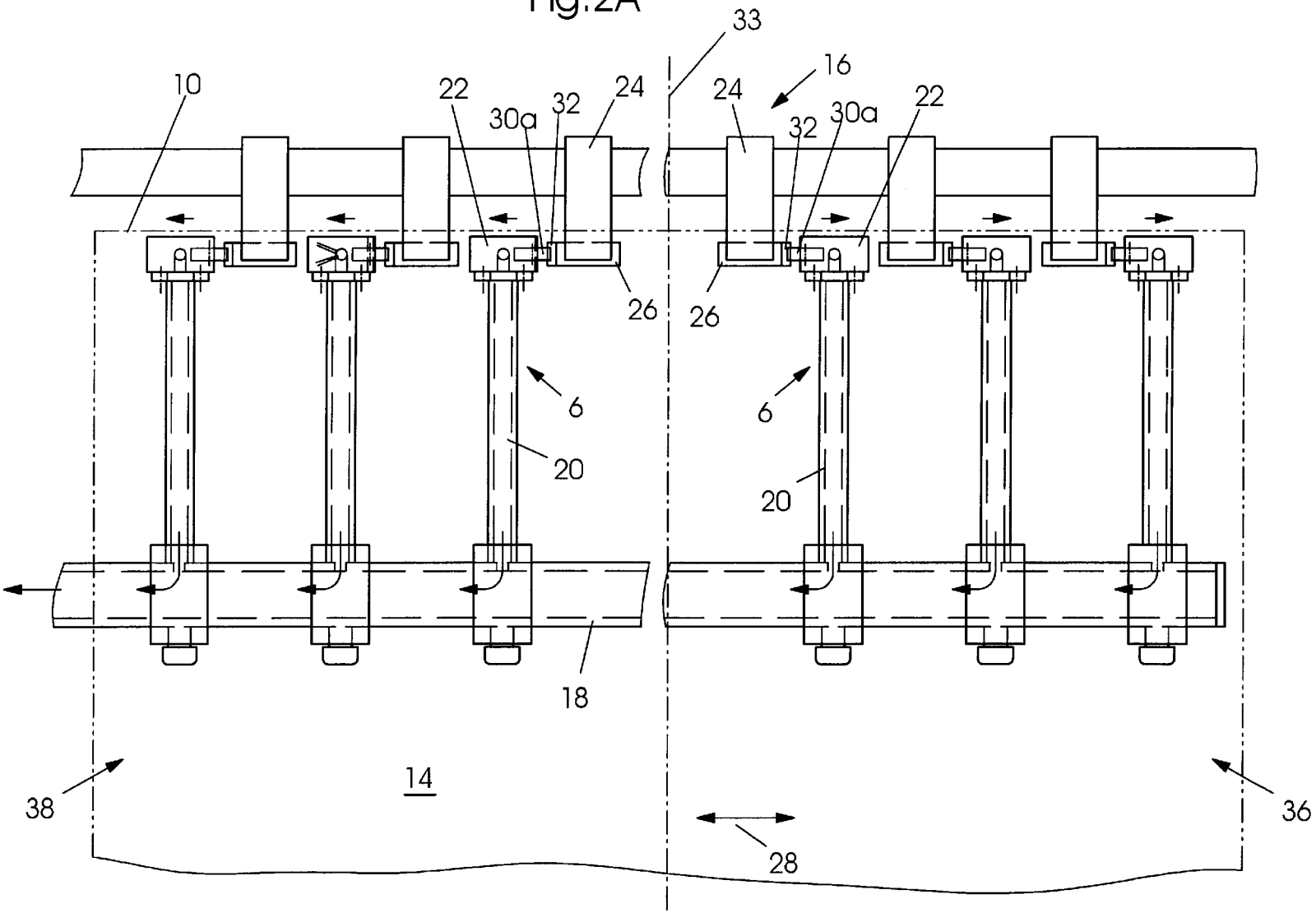
FIG. 2A is a fragmentary diagrammatic plan view of the circumferential surface of a downline sheet-conveying cylinder provided in a reversing device according to the invention, a multiplicity of suction grippers according to the invention being arranged on the cylinder.
Figure 2B:
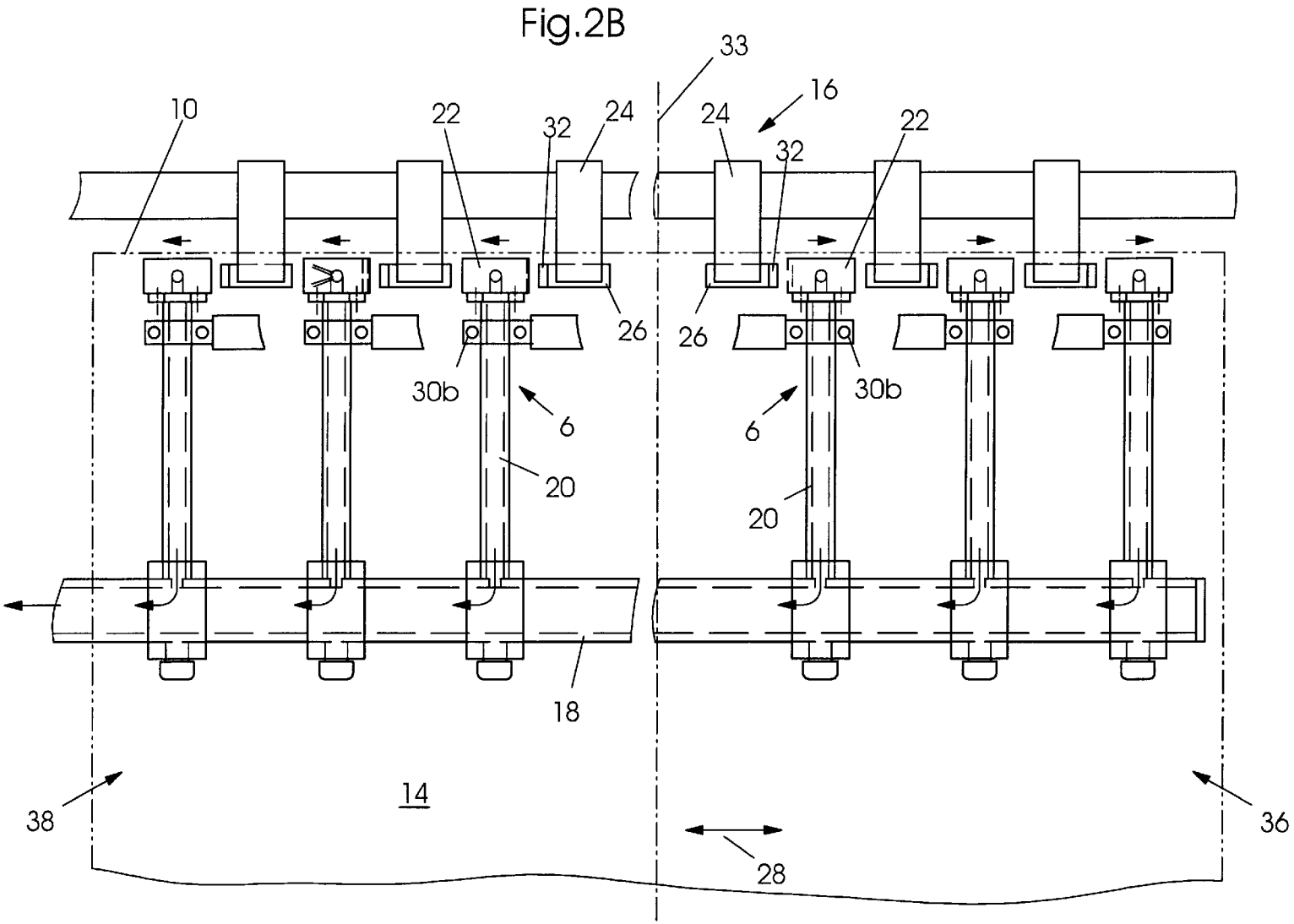
FIG. 2B is a fragmentary diagrammatic plan view of the circumferential surface of a downline sheet-conveying cylinder provided in a reversing device according to the invention, a multiplicity of suction grippers according to the invention being arrangaed on the cylinder.

As FIGS. 2A and 2B illustrates, a multiplicity of suction grippers 6 according to the invention are arranged in a transverse direction over the width of the downline sheet-conveying cylinder 4, each of the suction grippers 6 having a holding arm 20 that is fastened at one end thereof to a pivotable gripper shaft 18 and, at the other end thereof, carries a respective suction head 22.

As is apparent from FIGS. 2A and 2B, the suction heads 22, respectively, of the suction grippers 6 are preferably arranged between respective grippers 24 of the gripper device 16, which cooperate in a conventional manner with appertaining gripper pads 26. As shown diagrammatically in FIGS. 2A and 2B, the suction grippers 6 are provided thereon with devices which convert a substantially radially directed movement, represented by the double-headed arrow 5 in FIG. 3, of the suction grippers 6 into axially directed movements, represented by the double-headed arrow 28 in FIGS. 2A and 2B, when the suction grippers 6 pivot or move back in the direction towards the periphery 8 of the downline sheet-conveying cylinder 4, these movements causing a tautening and smoothing of the trailing edge 10 of the sheet 14 before it is transferred to the gripper device 16 of the cylinder 4.

Figure 3A:
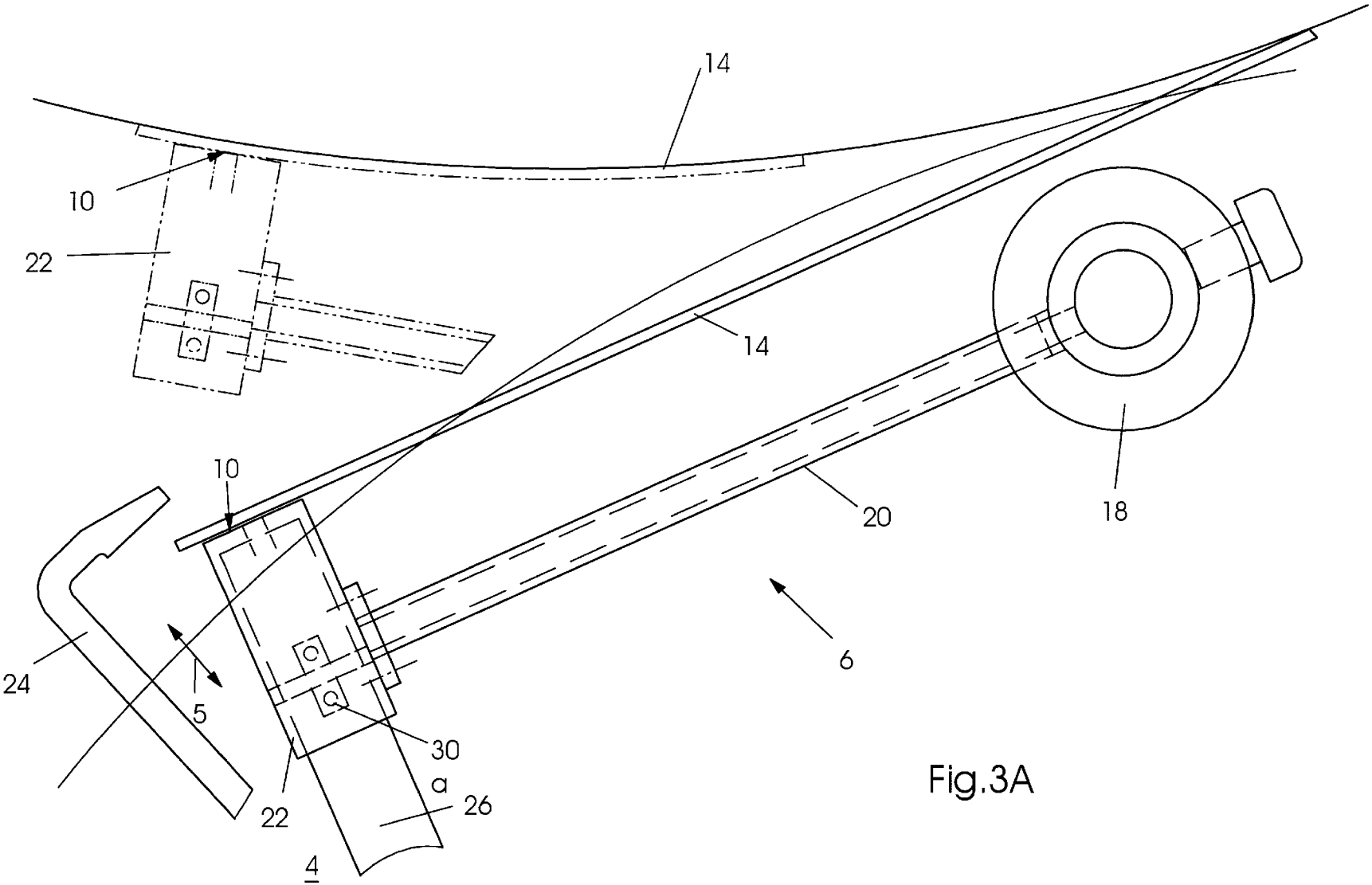
FIG. 3 is an enlarged diagrammatic side elevational view of a first embodiment of a suction gripper according to the invention during the transfer of a trailing edge of a sheet to be reversed.
Figure 3B:
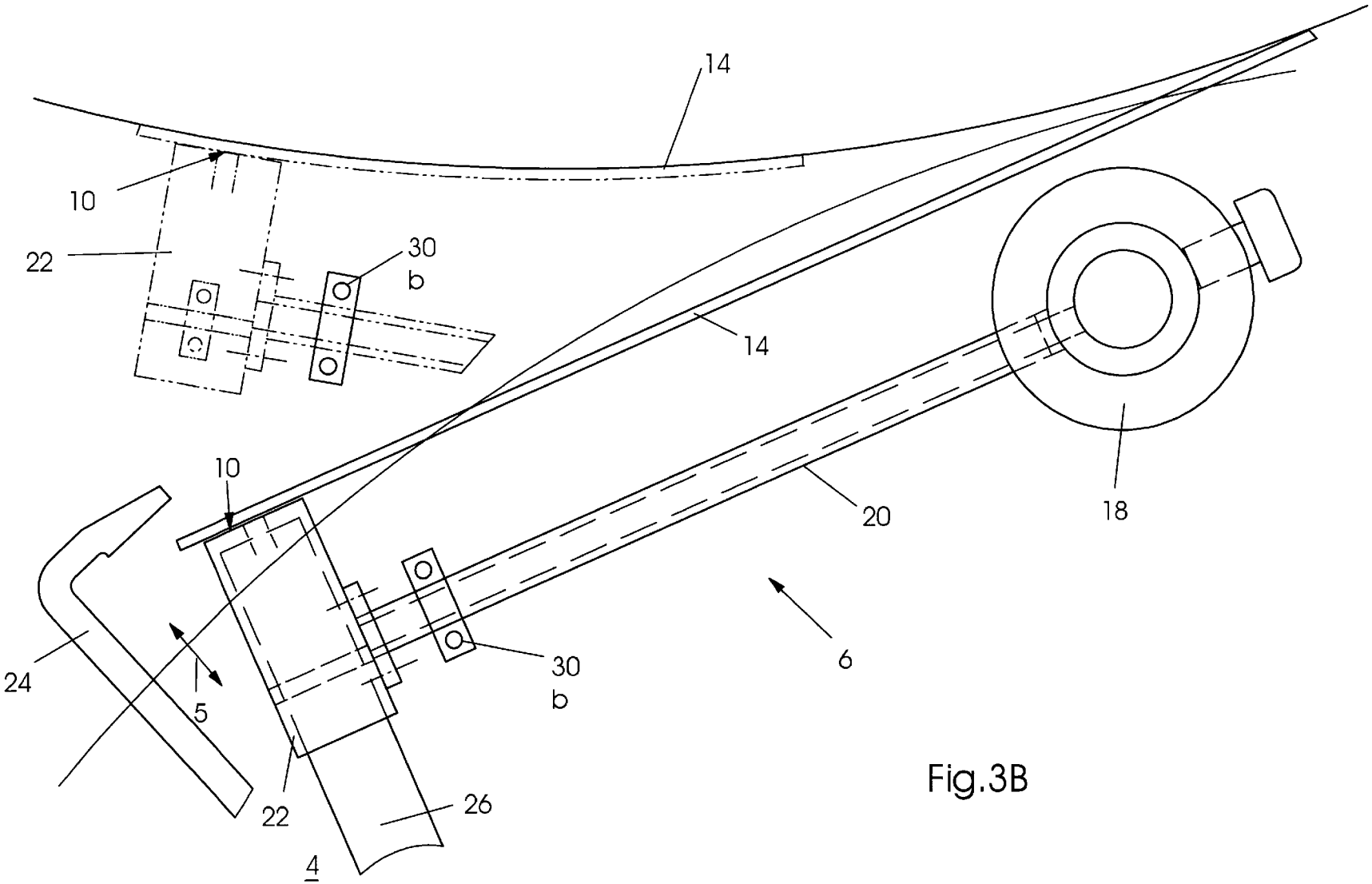

According to a first preferred embodiment of the invention, a device for converting the radial movement of the suction grippers 6 into axial movements is formed of rollers 30*a,* which are arranged so that they can rotate directly on the respective suction heads 22 of the suction grippers 6, as are illustrated in FIGS. 2A and 3A. According to another preferred embodiment of the invention, a device for converting the radial movement of the suction grippers 6 into axial movement is formed of rollers 30*b,* which are arranged so that they can rotate on the respective holding arms 20 of the suction grippers 6, as are illustrated diagrammatically in FIGS. 2B and 3B.

Figure 4A:
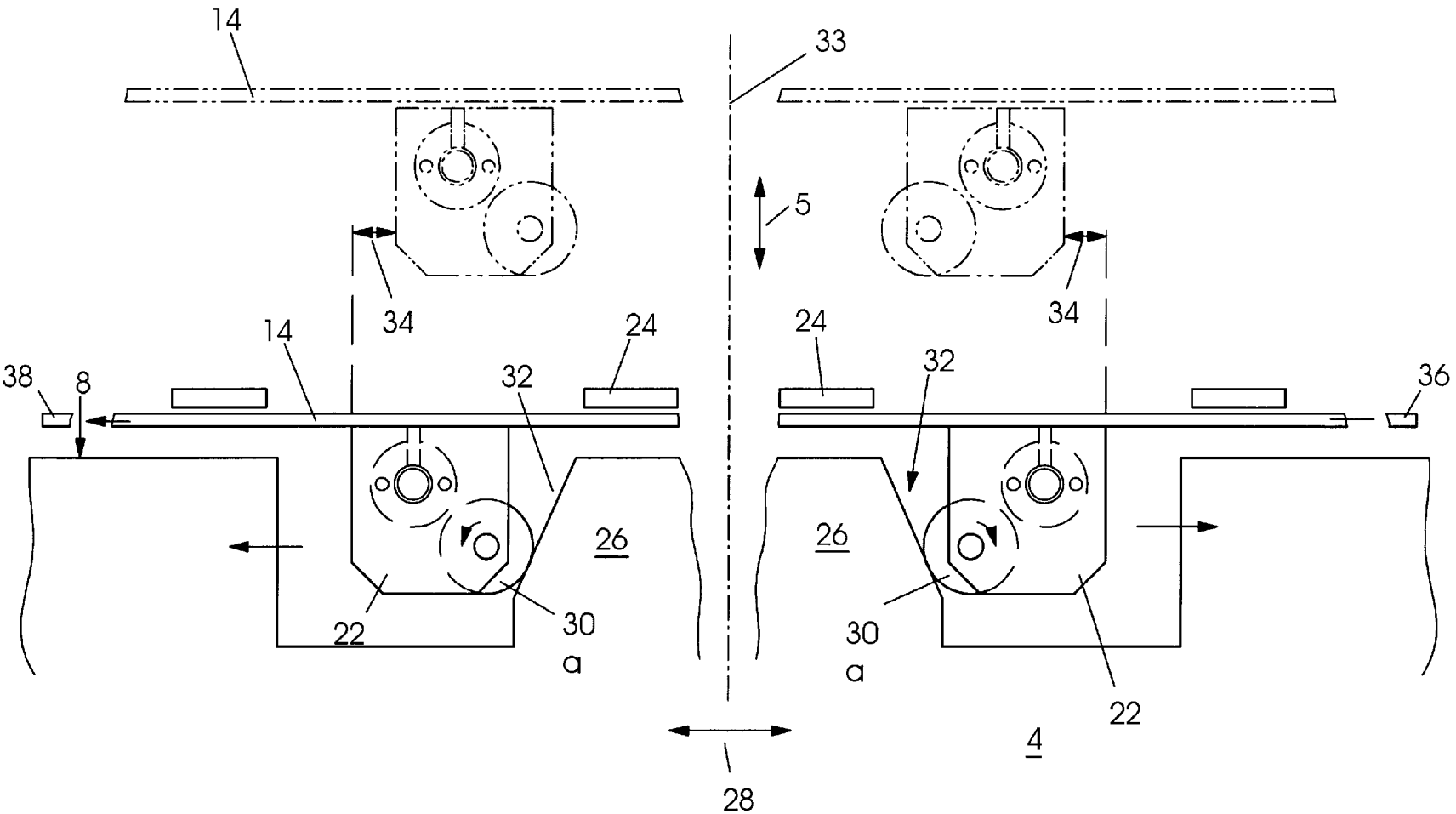
FIG. 4A is a diagrammatic cross-sectional view of the suction heads of two suction grippers according to the invention during the transfer and axial tensioning of the trailing edge of a sheet to be reversed.

As is shown in detail in FIG. 4A, in an embodiment of the invention based upon the rollers 30*a,* as the suction heads 22 move back in the direction towards the periphery 8 of the downline sheet-conveying cylinder 4, the rollers 30*a* are supported on inclined or oblique supporting surfaces 32 which are preferably formed on the gripper pads 26 of the gripper device 16. Consequently, before the sheet trailing edge 10 is gripped by the grippers 24 of the gripper device 16, during the back-pivoting movement, the suction heads 22 are subjected to tension in the axial direction 28 over a predefined tensioning travel 34, preferably from the center 33 of the sheet 14 in the direction towards the side edges 36 and 38 of the sheet 14.

Figure 4B:
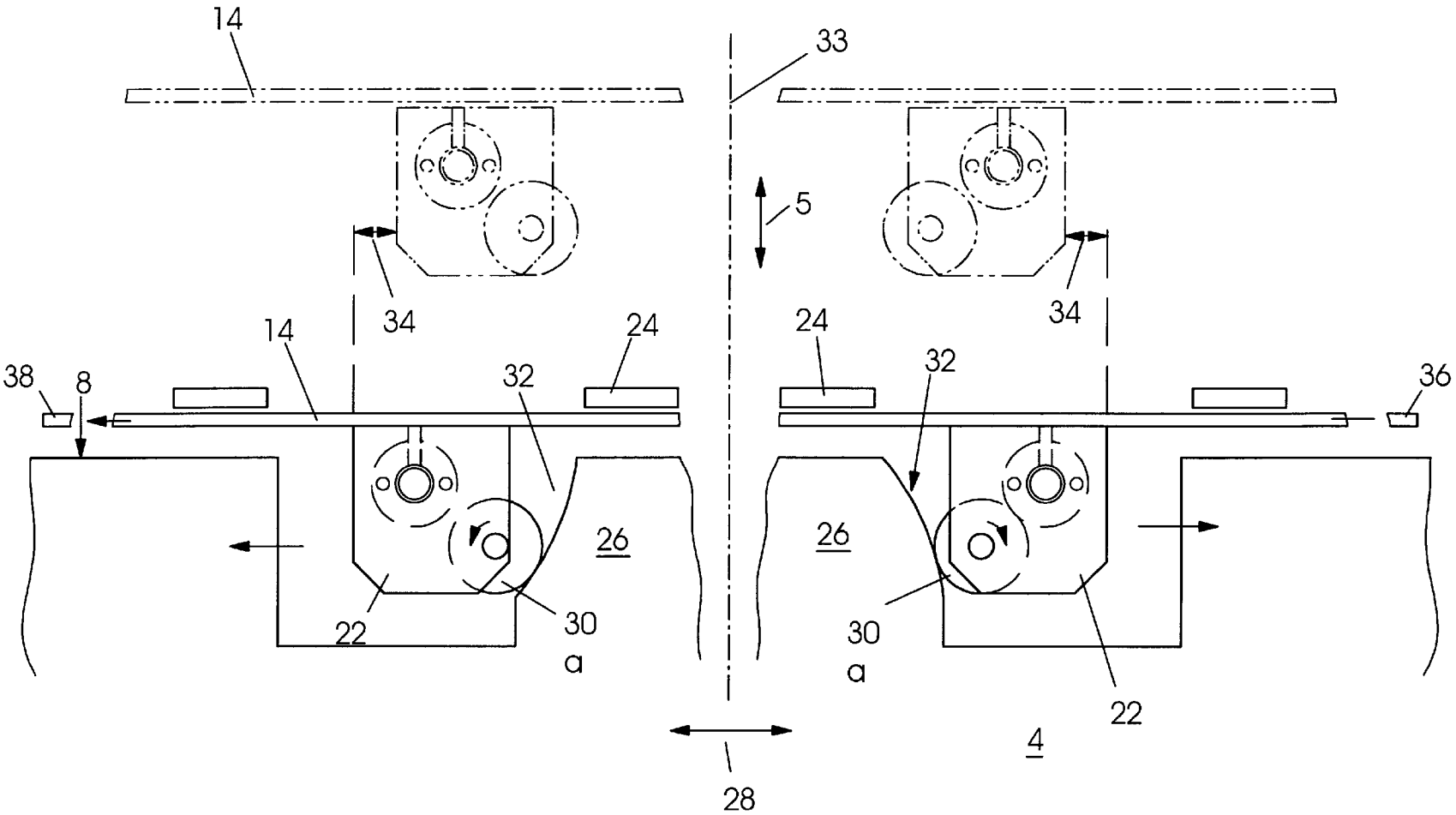
FIG. 4B is a diagrammatic cross-sectional view of the suction heads of two suction grippers according to the invention during the transfer and axial tensioning of the trailing edge of a sheet to be reversed.

The dependence of the tensioning travel 34 upon the return pivoting travel of the suction grippers 6 can thereby be adapted to the respective requirements by the configuration of the contour of the supporting surfaces 32. Thus, for example, in the case of a rectilinear configuration of the supporting surfaces 32, the result is a substantially linear dependence of the tensioning travel 34, whereas in the case of a convex or concave configuration of the supporting surfaces 32, as indicated by the broken lines in FIGS. 4*a* and 4B, a nonlinear dependence of the tensioning travel 34 is obtained. Furthermore, it may be advantageous if, in the case of a multiplicity of suction grippers 6 according to the invention illustrated in FIGS. 2*a* and 2B, the tensioning travel 34 increases from the center line 33 of the sheet towards the side edges 36 and 38, which may be achieved, for example, by a different angle of inclination of the supporting surfaces 32.

In the case wherein the rollers 30*a* are arranged directly on the suction heads 22, the supporting surfaces 32 are preferably arranged in the region of the gripper pads 26, whereas, in the case wherein the rollers 30*b* are fastened directly to the shaft 20 of the suction grippers 6, the supporting surfaces may be formed at the level of the rollers 30*b,* directly underneath the circumferential surface of the downline sheet-conveying cylinder 4; Rollers 30*a* and 30*b* are illustrated diagrammatically in FIGS. 2*a* and 2*b*, respectively.

According to an embodiment of the invention illustrated in FIG. 5, instead of the rollers 30*a* and 30*b,* respectively, on the suction head 22 or on the holding arm 20 of the suction grippers 6, provision may be made for sliding surfaces 31 which cooperate with the supporting surfaces 32 in order, as previously described, to produce an axial movement 28 of the suction heads 22 over a tensioning travel 34. In order to achieve an easier sliding movement and to reduce the forces needed to produce the axial movement, provision may be made for coating the sliding surfaces 31 on the suckers and/or the supporting surfaces 32 with a friction-reducing material, for example with polytetrafluoroethylene sold under the trademark TEFLON®.

In the preferred embodiment of the invention, the axial mobility of the suction gripper 6 according to the invention is made possible by providing that the shaft or shank 20, to which the suction head 22 is fastened, is flexible in the axial direction 28. To this end, the shaft 20 may be formed, for example, as a flexible hollow tube, that can be made of metal or carbon fiber material, for example. However, the tube may simultaneously also have an elasticity or flexibility in the radial direction 5, i.e., in the direction of the circumferential surface of the downline sheet-conveying cylinder 4. This ensures automatic adaptation of the suction grippers 6 according to the invention to different paper thicknesses, which allows the accuracy of transfer of the sheet trailing edge 10, and hence the printing quality, to be increased further.

Figure 6A:
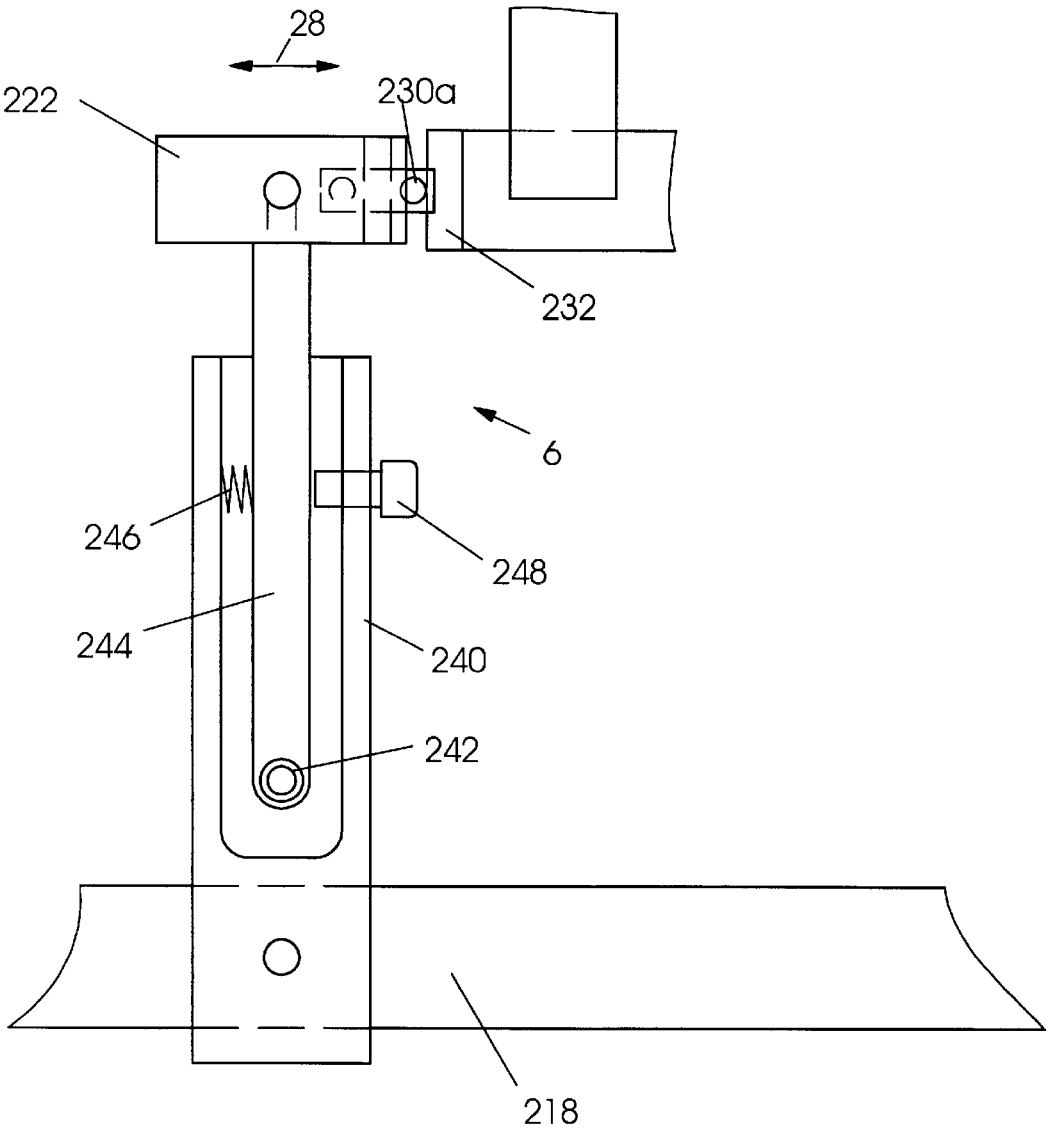
FIG. 6A is a diagrammatic plan view of a further embodiment of a suction gripper according to the invention, which has a rigid holding arm fastened to a gripper shaft so that it can pivot in the axial direction, and being acted on by a resilient member.
Figure 6B:
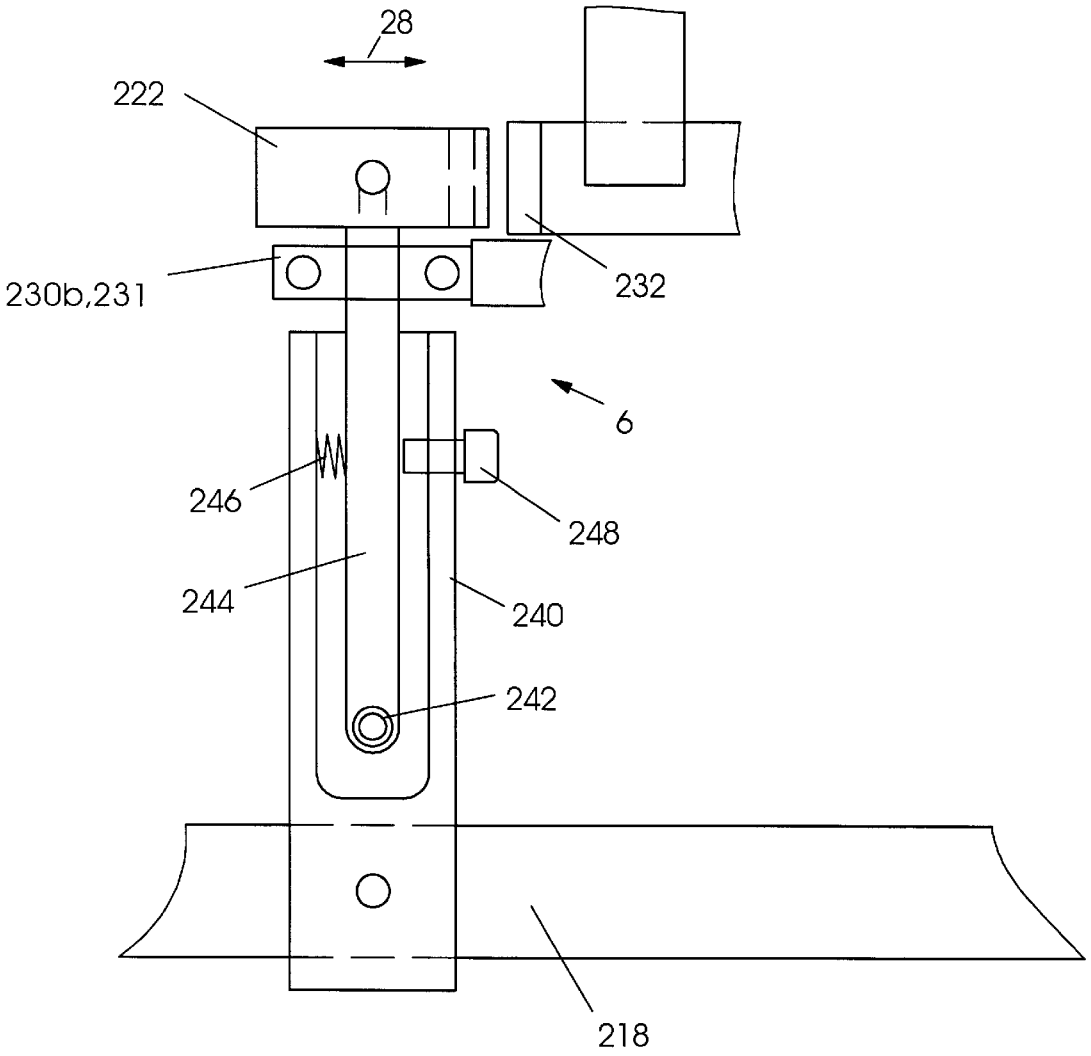
FIG. 6B is a diagrammatic plan view of a further embodiment of a suction gripper according to the invention, which has a rigid holding arm fastened to a gripper shaft so that it can pivot in the axial direction, and being acted on by a resilient member.

According to a further embodiment of the invention illustrated in FIGS. 6*a* 6*b,* the suction gripper 6 has a rigid holding arm 240, that is permanently connected to the gripper shaft 218 and has a suction head 222 fastened thereto via a rigid pivoting arm 244 so that it can pivot in the axial direction 28 about a pivot 242. The rigid pivoting arm 244 is forced in the direction of the appertaining side edge 36, 38 of the sheet 14, for example, counter to the force of a resilient member 246, the return movement of the pivoting arm 244 preferably being limited by an adjusting screw 248 screwed into the rigid holding arm 240. The rollers 230*a* shown in FIG. 6A or sliding surfaces 230*b,* shown in FIG. 6B 231 which cooperate with the supporting surfaces 232 are preferably arranged directly on the suction head 222 in this embodiment of the invention. In a similar manner, however, provision may also be made to arrange the rollers or sliding surfaces on the rigid pivoting arm 244, as is indicated FIG. 6B.

Figure 7A:
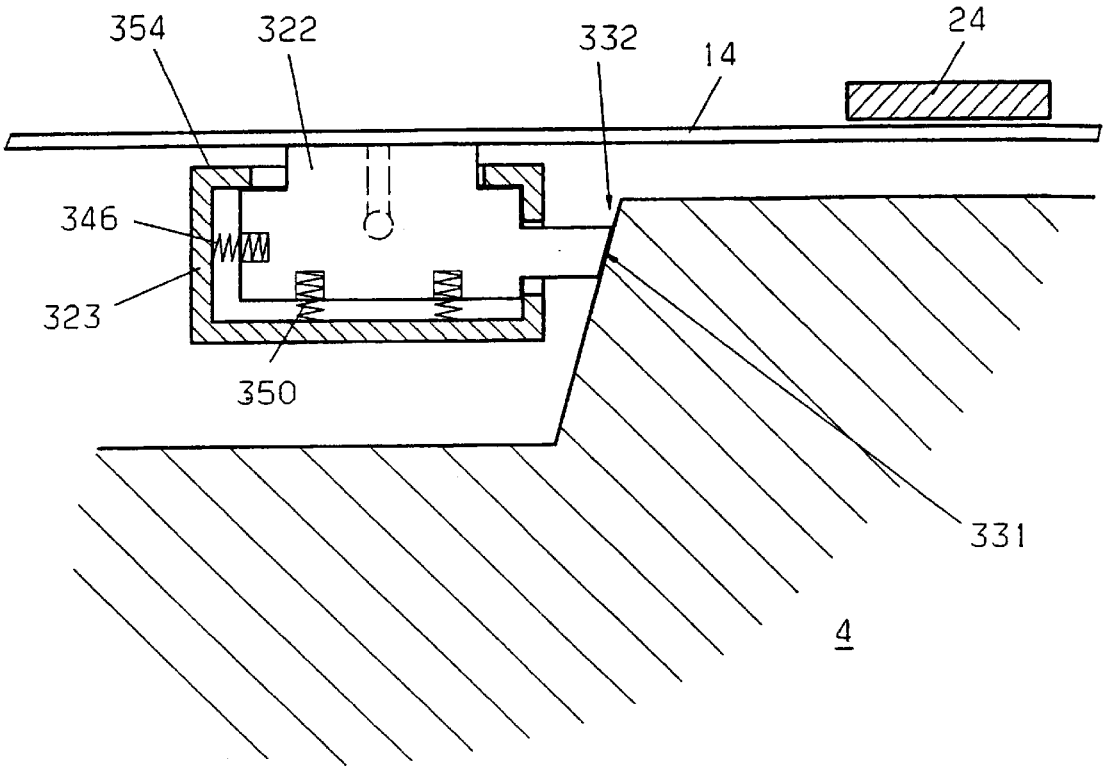
FIG. 7*a* is a cross-sectional view of an additional embodiment of a suction gripper according to the invention, in which a suction head is fastened so that it can move on a rigid holding arm of the suction gripper and is forced by a resilient member in the axial direction towards the center of the circumferential surface of the sheet-conveying cylinder and against a supporting surface.
Figure 7B:
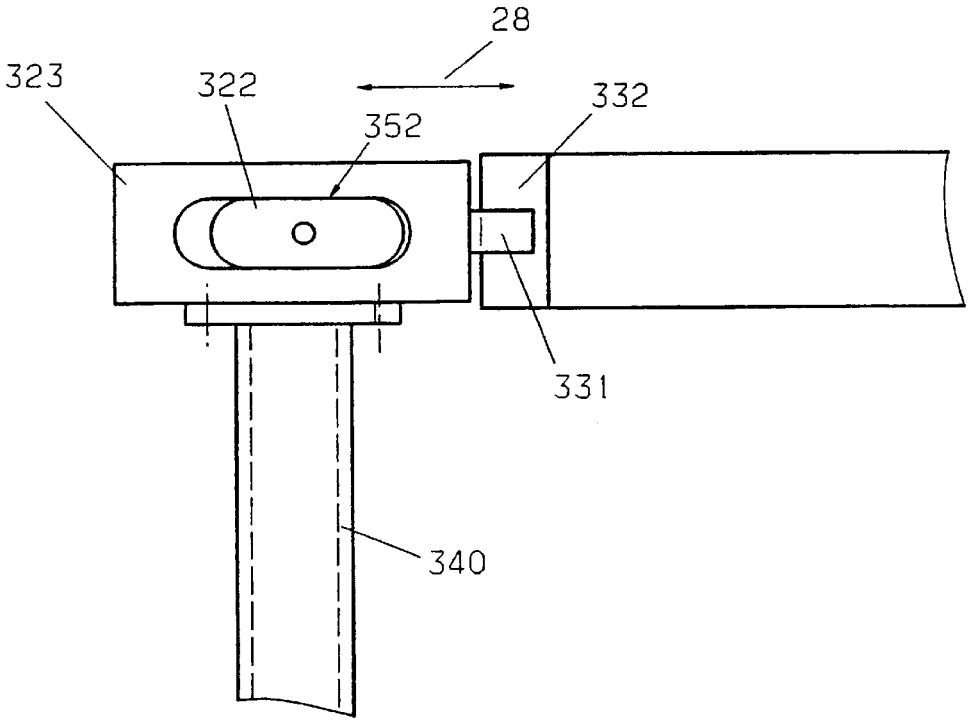
FIG. 7*b* is a diagrammatic top plan view of FIG. 7*a*.

According to a further embodiment of the invention shown in FIGS. 7*a* and 7*b,* the suction gripper 6 according to the invention has a rigid holding arm 340 which can be pivoted via a non-illustrated gripper shaft and is provided with a suction head 322 that is fastened thereto so that it can move in the axial direction 28, for example, in a housing 323 that is disposed on the holding arm 340. As the cross-sectional view of FIG. 7*a* illustrates, the suction head 322 is forced in the axial direction 28 against the supporting surface 332 by a resilient member 346, the axial movement of the suction head 322 in this embodiment of the invention preferably being produced by a sliding surface 331 that is formed directly on the suction head 322 and extends out of the housing 323. As is further shown in FIG. 7*a,* additional resilient members 350 may be provided in order to ensure automatic adaptation of the suction gripper according to the invention to various printing-material thicknesses, these resilient elements 350 acting with a resilient force in the radial direction 5 on the suction head 322, that is guided in the housing 323 in a radial guide 352 that is represented diagrammatically in FIGS. 7*a* and *b,* it being possible for a stop for limiting travel to be formed, for example, directly by the top 354 of the housing 323.

In addition, there is a possibility of combining the axial tensioning or tautening movement of the suction grippers simultaneously with a tensioning or tautening movement of the suction grippers in the circumferential direction, it being possible for this to take place, for example, by appropriately constructing the gear mechanism which pivots the suction grippers, so that the overall result is tautening of the sheet 14 in a diagonal direction.

We claim:

1. In a reversing device of a sheet-fed rotary printing machine, a suction gripper for taking over a trailing edge of a sheet conveyed on an upline sheet-conveying cylinder, being movable out of a periphery of a downline sheet-conveying cylinder, gripping the sheet to be reversed in a region of the trailing edge thereof, and being movable back in a substantially radial direction towards the downline sheet-conveying cylinder for transferring thereat the trailing edge of the sheet to a further gripper device, comprising a device for converting the substantially radial return movement of the suction gripper into an axial movement of the suction gripper so as to tauten the sheet.

2. The reversing device according to claim 1, wherein said converting device comprises one surface member of a plurality thereof consisting of a roller rotatably fastened to the suction gripper and a sliding surface, said one surface member cooperatively engaging an inclined supporting surface disposed on the downline sheet-conveying cylinder.

3. The reversing device according to claim 2, wherein said supporting surface is formed on a gripper pad of the further gripper device.

4. The reversing device according to claim 2, wherein said roller is arranged directly on the resilient holding arm of the suction gripper.

5. The reversing device according to claim 2, wherein said suction gripper has a rigid holding arm pivotable by a gripper shaft in the substantially radial direction, said holding arm having arranged thereon a suction head pivotable in the substantially axial direction, and a resilient member braced against said holding arm for applying a force in the axial direction to said suction head.

6. The reversing device according to claim 2, wherein said sliding surface is arranged directly on the resilient holding arm of the suction gripper.

7. The reversing device according to claim 1, wherein the suction gripper has a holding arm that is resilient in the axial direction and carries a suction head for gripping by suction the sheet to be reversed.

8. The reversing device according to claim 7, wherein said roller is arranged on said suction head of the suction gripper.

9. The reversing device according to claim 7, wherein said sliding surface is arranged on said suction head of the suction gripper.

10. The reversing device according to claim 1, wherein the suction gripper has a rigid holding arm whereon there is movably fastened a suction head for gripping by suction the sheet to be reversed, and a resilient member for applying to the holding arm a resilient force in the axial direction.

11. The reversing device according to claim 10, wherein said roller is arranged directly on said suction head of the suction gripper.

12. The reversing device according to claim 10, including at least one further resilient member for applying a resilient force to said suction head in the direction of the circumferential surface of the upline sheet-conveying cylinder.

13. The reversing device according to claim 10, wherein said sliding surface is arranged directly on said suction head of the suction gripper.

14. The reversing device according to claim 1, wherein said axial tautening movement extends over a distance increasing substantially linearly with said return movement of the suction gripper towards the periphery of the downline sheet-conveying cylinder.

15. The reversing device according to claim 1, wherein said axial tautening movement extends over a distance, said distance over which said axial tautening movement extends increases substantially nonlinearly with said return movement.

16. The reversing device according to claim 14, including a multiplicity of the suction grippers for tautening the sheet, that is to be reversed, in the axial direction from the center towards the side edges thereof.

17. The reversing device according to claim 16, wherein said distance over which said axial tensioning movement of the suction grippers extends increases from the center of the sheet towards the side edges of the sheet.

* * * * *